US010731883B2

(12) United States Patent
Richardson et al.

(10) Patent No.: US 10,731,883 B2
(45) Date of Patent: Aug. 4, 2020

(54) AIR CIRCULATION SYSTEM

(71) Applicant: QUALCOMM Incorporated, San Diego, CA (US)

(72) Inventors: Laurence Richardson, Near Ely (GB); Mayank Batra, Cambridge (GB); Christopher Church, Cambridge (GB); Magnus Sommansson, Veberod (SE); Jonathan Tanner, Sidmouth (GB)

(73) Assignee: QUALCOMM Incorporated, San Diego, CA (US)

( * ) Notice: Subject to any disclaimer, the term of this patent is extended or adjusted under 35 U.S.C. 154(b) by 176 days.

(21) Appl. No.: 16/110,280

(22) Filed: Aug. 23, 2018

(65) Prior Publication Data

US 2020/0063998 A1 Feb. 27, 2020

(51) Int. Cl.

| | |
|---|---|
| ***F15C 1/04*** | (2006.01) |
| ***F24F 11/00*** | (2018.01) |
| ***F24F 7/007*** | (2006.01) |
| ***F24F 11/58*** | (2018.01) |
| *F24F 11/72* | (2018.01) |
| *H04R 1/02* | (2006.01) |

(52) U.S. Cl.

CPC ..... *F24F 11/0001* (2013.01); *F24F 7/007* (2013.01); *F24F 11/58* (2018.01); *F24F 11/72* (2018.01); *H04R 1/02* (2013.01)

(58) Field of Classification Search

CPC ..... F24F 11/0001; F24F 11/58; F24F 11/72; F24F 7/007; H04R 1/02

USPC ..... 137/828

See application file for complete search history.

(56) References Cited

U.S. PATENT DOCUMENTS

| | | | | |
|---|---|---|---|---|
| 3,398,758 | A * | 8/1968 | Unfried | H04R 1/42 116/137 R |
| 3,500,951 | A * | 3/1970 | Beeken | G01B 17/00 181/123 |
| 5,040,560 | A * | 8/1991 | Glezer | F15C 1/04 137/13 |
| 5,889,870 | A * | 3/1999 | Norris | G10K 15/02 381/77 |
| 8,636,032 | B2 * | 1/2014 | Burns | F04B 17/00 137/828 |
| 9,534,929 | B1 * | 1/2017 | Stamatakis | G01D 4/002 |
| 2003/0179899 | A1 * | 9/2003 | Welker | H04R 1/02 381/386 |
| 2007/0261558 | A1 * | 11/2007 | Ashworth | F24F 11/0001 96/397 |

(Continued)

*Primary Examiner* — Minh Q Le
(74) *Attorney, Agent, or Firm* — Holland & Hart LLP/Qualcomm

(57) ABSTRACT

Methods, systems, and devices for ventilating are described. Generally, the described methods, systems, and devices may support generating subsonic air pressure waves for enhancing air ventilation, heating, and cooling applications. Specifically, a transducer device may be configured to provide air ventilation, heating, and cooling based on a generated waveform. For example, the transducer device may be coupled to a waveform generator that may generate a repeating asymmetric waveform having an attack and decay profile for generating pulses (e.g., pressure waves) that propagate outward. In some implementations, multiple transducer devices may be configured to operate synchronously with each other to further enhance the air ventilation, heating, and cooling application.

20 Claims, 11 Drawing Sheets

(56) References Cited

U.S. PATENT DOCUMENTS

| | | | | |
|---|---|---|---|---|
| 2008/0031472 | A1* | 2/2008 | Freeman | H04R 1/227 381/89 |
| 2009/0305627 | A1* | 12/2009 | Joneleit | F24F 11/0001 454/333 |
| 2010/0224274 | A1* | 9/2010 | Tokita | B01F 11/0266 137/826 |
| 2011/0270446 | A1* | 11/2011 | Scharf | F24F 11/0001 700/282 |
| 2015/0050876 | A1* | 2/2015 | Sakai | F24F 11/0001 454/256 |
| 2015/0377504 | A1* | 12/2015 | Nagase | F24F 7/007 454/239 |
| 2016/0209059 | A1* | 7/2016 | Castillo | G05B 15/02 |
| 2018/0023826 | A1* | 1/2018 | Tucker | F24F 11/62 700/276 |
| 2018/0202674 | A1* | 7/2018 | Lin | F24F 11/30 |
| 2018/0347837 | A1* | 12/2018 | Nugrahani | F24F 11/0001 |
| 2019/0093915 | A1* | 3/2019 | Lee | F24F 1/0003 |
| 2019/0234632 | A1* | 8/2019 | Reeder | F24F 11/0001 |
| 2020/0034109 | A1* | 1/2020 | Price | G06F 3/165 |
| 2020/0067340 | A1* | 2/2020 | Batra | H02J 7/025 |

* cited by examiner

600

AIR CIRCULATION SYSTEM

BACKGROUND

The following relates generally to ventilating, and more specifically to an air circulation system including a transducer device for generating subsonic air pressure waves for enhancing applications associated with heating, ventilation, and air conditioning related systems. Although some air circulation systems that are fan-based, which use a rotating fan-blade to provide air ventilation, heating, and cooling, are generally effective these fan-based systems suffer from certain challenges. One challenge is that the rotation of the fan-blade generates significant levels of noise, which continues to increase as wear and tear of the bearing of the fan-blade progresses. Another challenge in the fan-based system is that, to prevent hazardous conditions from occurring, the fan-blade is configured within an enclosure, which impairs the airflow and reduces the efficiency of the fan-blade. Improving techniques, methods, and related devices for related to air ventilation, heating, and cooling applications may be desirable.

SUMMARY

The described techniques relate to improved methods, systems, devices, and apparatuses that support air circulation system. A transducer device may generate subsonic air pressure waves for enhancing air ventilation, heating, and cooling applications. Specifically, the transducer device may be configured to provide air ventilation, heating, and cooling based on a subsonic waveform profile. For example, the transducer device may be coupled to a waveform generator that may generate a repeating asymmetric subsonic waveform having an attack and decay profile for generating pulses (e.g., pressure waves) that propagate outward. In some implementations, multiple transducer devices may be configured to operate synchronously with each other to further enhance the air ventilation, heating, and cooling application.

A method of ventilating is described. The method may include establishing a wireless connection between a first transducer device and a second transducer device, receiving a message from the first transducer device including parameters of a first subsonic waveform profile of the first transducer device, generating at the second transducer device a second subsonic waveform profile based on the parameters of the first subsonic waveform profile, and driving the second transducer device based on the second subsonic waveform profile to generate a first set of air pressure pulses configured to combine with a second set of air pressure pulses based on the first subsonic waveform profile.

An apparatus for ventilating is described. The apparatus may include a processor, memory in electronic communication with the processor, and instructions stored in the memory. The instructions may be executable by the processor to cause the apparatus to establish a wireless connection between a first transducer device and a second transducer device, receive a message from the first transducer device including parameters of a first subsonic waveform profile of the first transducer device, generate at the second transducer device a second subsonic waveform profile based on the parameters of the first subsonic waveform profile, and drive the second transducer device based on the second subsonic waveform profile to generate a first set of air pressure pulses configured to combine with a second set of air pressure pulses based on the first subsonic waveform profile.

Another apparatus for ventilating is described. The apparatus may include means for establishing a wireless connection between a first transducer device and a second transducer device, receiving a message from the first transducer device including parameters of a first subsonic waveform profile of the first transducer device, generating at the second transducer device a second subsonic waveform profile based on the parameters of the first subsonic waveform profile, and driving the second transducer device based on the second subsonic waveform profile to generate a first set of air pressure pulses configured to combine with a second set of air pressure pulses based on the first subsonic waveform profile.

A non-transitory computer-readable medium storing code for ventilating is described. The code may include instructions executable by a processor to establish a wireless connection between a first transducer device and a second transducer device, receive a message from the first transducer device including parameters of a first subsonic waveform profile of the first transducer device, generate at the second transducer device a second subsonic waveform profile based on the parameters of the first subsonic waveform profile, and drive the second transducer device based on the second subsonic waveform profile to generate a first set of air pressure pulses configured to combine with a second set of air pressure pulses based on the first subsonic waveform profile.

Some examples of the method, apparatuses, and non-transitory computer-readable medium described herein may further include operations, features, means, or instructions for synchronizing a clock of the second transducer device with a clock of the first transducer device based on a timing synchronization function and coordinating the second transducer device to generate the first set of air pressure pulses based on the synchronizing, where the first set of air pressure pulses combine with the second set of air pressure pulses based on the coordination.

Some examples of the method, apparatuses, and non-transitory computer-readable medium described herein may further include operations, features, means, or instructions for identifying a phase associated with the first subsonic waveform profile based on the parameters received in the message from the first transducer device and setting a phase associated with the second subsonic waveform profile based on the identified phase associated with the first subsonic waveform profile, where generating at the second transducer device the second subsonic waveform profile may be based on the set phase associated with the second subsonic waveform profile.

Some examples of the method, apparatuses, and non-transitory computer-readable medium described herein may further include operations, features, means, or instructions for transmitting, to the first transducer device, a second message from the second transducer device including parameters of the second subsonic waveform profile including the set phase, receiving feedback from the first transducer device based on the second message and adjusting the phase associated with the second subsonic waveform profile based on the feedback.

Some examples of the method, apparatuses, and non-transitory computer-readable medium described herein may further include operations, features, means, or instructions for constructively combining the first set of air pressure pulses with the second set of air pressure pulses based on the phase associated with the first subsonic waveform profile and the phase associated with the second subsonic waveform profile.

Some examples of the method, apparatuses, and non-transitory computer-readable medium described herein may further include operations, features, means, or instructions for establishing a second wireless connection between the second transducer device and an audio source device and receiving, from the audio source device, an audio waveform having a set of audio pulses based on the second wireless connection.

Some examples of the method, apparatuses, and non-transitory computer-readable medium described herein may further include operations, features, means, or instructions for superimposing the set of audio pulses on the combined first set of air pressure pulses and the second set of air pressure pulses and propagating the set of audio pulses on the combined first set of air pressure pulses and the second set of air pressure pulse based on the superimposing, where driving the second transducer device may be further based on propagating the set of audio pulses on the combined first set of air pressure pulses and the second set of air pressure pulse.

In some examples of the method, apparatuses, and non-transitory computer-readable medium described herein, the first plurality of air pressure pulses associated with the first subsonic waveform profile and the second plurality of air pressure pulses associated with the second subsonic waveform profile are asymmetrically-shaped.

In some examples of the method, apparatuses, and non-transitory computer-readable medium described herein, the wireless connection comprises one or more of: a Bluetooth connection, Bluetooth low-energy (BLE) connection, a near-field communication (NFC) connection, or a Wi-Fi connection.

In some examples of the method, apparatuses, and non-transitory computer-readable medium described herein, the first transducer device and the second transducer device comprises a heat-resistance material.

In some examples of the method, apparatuses, and non-transitory computer-readable medium described herein, the first plurality of air pressure pulses associated with the first subsonic waveform profile and the second plurality of air pressure pulses associated with the second subsonic waveform profile have a fundamental frequency in a subsonic frequency range.

DETAILED DESCRIPTION

The improved techniques, methods, and related devices described herein may support generating subsonic air pressure waves for enhancing applications associated with heating, ventilation, and air conditioning related systems. Specifically, a transducer device may be configured to provide air ventilation, heating, and cooling based at least in part on a generated waveform. The transducer device may be formed from heat-resistant materials and integrated with a heat source such as a ceramic element, to support the air ventilation, heating, and cooling aspects. In addition, the airflow increases the average heat output that is achievable from the heating element. To evade challenges related to some air circulation systems, the transducer device may be coupled to a waveform generator that may generate a repeating asymmetric waveform having an attack and decay profile to generate pulses (e.g., pressure waves) that propagate outward. The waveform may also have a fundamental frequency that may be subsonic resulting in an inaudible pulse.

In some implementations, multiple transducer devices may be configured to operate synchronously with each other. For example, each transducer device may be coupled with a microcontroller that may be in wireless communications with other microcontrollers of the multiple transducer devices. The waveform associated with each transducer device may be synchronized by exchanging parameters (e.g., via Bluetooth) to coordinate a phase of each waveform for each transducer device. In other implementations, an audio waveform may be superimposed on the waveform being used for air ventilation, heating, and cooling, thereby enabling the system to be both part of a surround sound system and an air circulation system. As a result, the transducer device may provide an improved air circulation system providing an enhanced efficient and noiseless alternative to existing air circulation systems, while also supporting additional applications (e.g., surround sound systems).

Aspects of the disclosure are initially described in the context of a wireless communications system. Aspects of the disclosure are further described in the context of a waveform, environment, and process flow. Aspects of the disclosure are further illustrated by and described with reference to apparatus diagrams, system diagrams, and flowcharts that relate to air circulation system.

Figure 1:
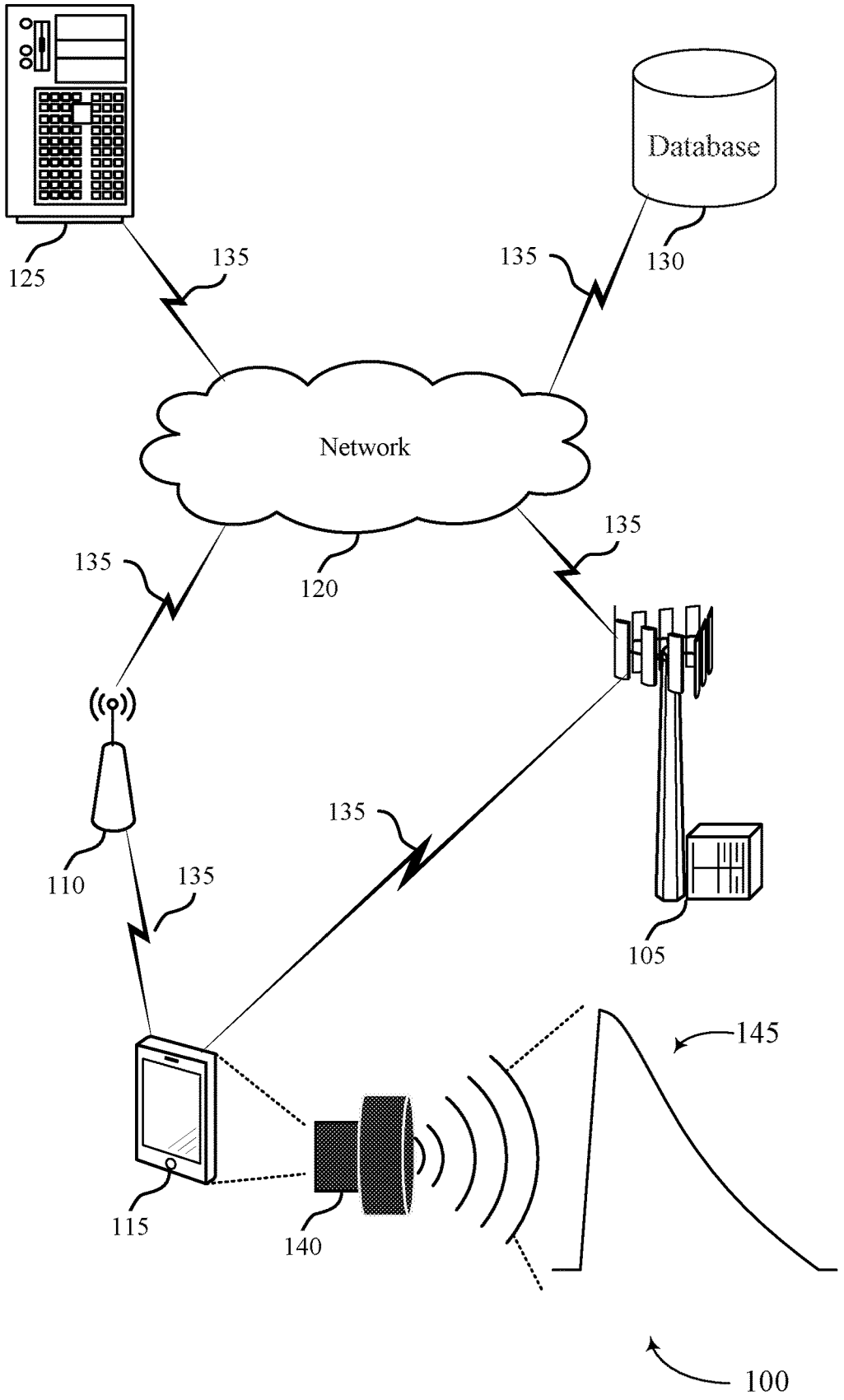
FIG. 1 illustrates an example of systems for ventilating that supports an air circulation system in accordance with aspects of the present disclosure.

FIG. 1 illustrates an example of a wireless communications system 100 that supports air circulation system in accordance with aspects of the present disclosure. The system 100 may include a base station 105, an access point 110, a device 115, a server 125, and a database 130. The base station 105, the access point 110, the device 115, the server 125, and the database 130 may communicate with each other via network 120 using wireless communications links 135.

The base station 105 may wirelessly communicate with the device 115 via one or more base station antennas. Base station 105 described herein may include or may be referred to by those skilled in the art as a base transceiver station, a radio base station, an access point, a radio transceiver, a NodeB, an eNodeB (eNB), a next-generation Node B or giga-nodeB (either of which may be referred to as a gNB), a Home NodeB, a Home eNodeB, or some other suitable terminology. The device 115 described herein may be able to communicate with various types of base stations and network equipment including macro eNBs, small cell eNBs, gNBs, relay base stations, and the like. The access point 110 may be configured to provide wireless communications for the device 115 over a relatively smaller area compared to the base station 105.

In some examples, the device 115 may be stationary and/or mobile. In some examples, the device 115 may include an automotive vehicle, an aerial vehicle, such as an unmanned aerial vehicle (UAV), ground vehicles and robots, and/or some combination thereof. The device 115 may, additionally or alternatively, include or be referred to by those skilled in the art as a user equipment (UE), a user device, a cellular phone, a smartphone, a Bluetooth device, a Wi-Fi device, a mobile station, a subscriber station, a mobile unit, a subscriber unit, a wireless unit, a remote unit, a mobile device, a wireless device, a wireless communications device, a remote device, an access terminal, a mobile terminal, a wireless terminal, a remote terminal, a handset, a user agent, a mobile client, a client, and/or some other suitable terminology. In some cases, the device 115 may also be able to communicate directly with another device (e.g., using a peer-to-peer (P2P) or device-to-device (D2D) protocol).

The device 115 may also include a transducer device 140, which may be configured with a heat-resistance material, and operate according to a subsonic waveform profile 145 for providing air ventilation, heating, and cooling. In some case, the transducer device 140 may be standalone device or part of the device 115 (e.g., configured with the device 115, embedded within the device 115, or installed on the device 115). For example, the transducer device 140, in some implementations, may provide air circulation in rooms as well as within smaller enclosures such as appliances (e.g., laptops, smartphones, ovens). The transducer device 140-*a* may have one or more characteristics associated with a subwoofer. The subsonic waveform profile 145 may be asymmetrically-shaped with an attack and decay profile that may be effective for creating pulses of air that propagate away from the transducer device 140. The subsonic waveform profile 145 may also have a fundamental frequency that may be subsonic such that the pressure waves created are inaudible.

The device 115 may include memory, a processor, an output, and a communication module. The processor may be a general-purpose processor, a digital signal processor (DSP), an image signal processor (ISP), a central processing unit (CPU), a graphics processing unit (GPU), a microcontroller, an application-specific integrated circuit (ASIC), a field-programmable gate array (FPGA), and/or the like. The processor may be configured to process data (e.g., subsonic waveform profiles, parameter values, setting) from and/or write data (e.g., subsonic waveform profiles, parameter values, setting) to the memory.

The memory may be, for example, a random-access memory (RAM), a memory buffer, a hard drive, a database, an erasable programmable read only memory (EPROM), an electrically erasable programmable read only memory (EEPROM), a read only memory (ROM), a flash memory, a hard disk, a floppy disk, cloud storage, and/or so forth. In some examples, devices 115 may include one or more hardware-based modules (e.g., DSP, FPGA, ASIC) and/or software-based modules (e.g., a module of computer code stored at the memory and executed at the processor, a set of processor-readable instructions that may be stored at the memory and executed at the processor) associated with executing an application, such as, for example, air ventilation, heating, and cooling.

The network 120 that may provide encryption, access authorization, tracking, Internet Protocol (IP) connectivity, and other access, computation, modification, and/or functions. Examples of network 120 may include any combination of cloud networks, local area networks (LAN), wide area networks (WAN), virtual private networks (VPN), wireless networks (using 802.11, for example), cellular networks (using third generation (3G), fourth generation (4G), long-term evolved (LTE), or new radio (NR) systems (e.g., fifth generation (5G) for example), etc. Network 120 may include the Internet.

The server 125 may include any combination of a data server, a cloud server, a server associated with an automation service provider, proxy server, mail server, web server, application server, a map server, a road assistance server, database server, communications server, home server, mobile server, or any combination thereof. The server 125 may also transmit to the device 115 a variety of information, such as instructions or commands (e.g., subsonic waveform profiles) relevant to the transducer device 140. The database 130 may store data that may include instructions or commands (e.g., subsonic waveform profiles) relevant to the transducer device 140. The device 115 may retrieve the stored data from the database 130 via the base station 105 and/or the access point 110.

The wireless communications links 135 shown in the system 100 may include uplink transmissions from the device 115 to the base station 105, the access point 110, or the server 125, and/or downlink transmissions, from the base station 105, the access point 110, the server 125, and/or the database 130 to the device 115. The downlink transmissions may also be called forward link transmissions while the uplink transmissions may also be called reverse link transmissions. The wireless communications links 135 may transmit bidirectional communications and/or unidirectional communications. Wireless communications links 135 may include one or more connections, including but not limited to, 345 MHz, Wi-Fi, Bluetooth, Bluetooth Low Energy, cellular, Z-Wave, 802.11, peer-to-peer, LAN, wireless local area network (WLAN), Ethernet, FireWire, fiber optic, and/or other connection types related to wireless communication systems.

Figure 2:
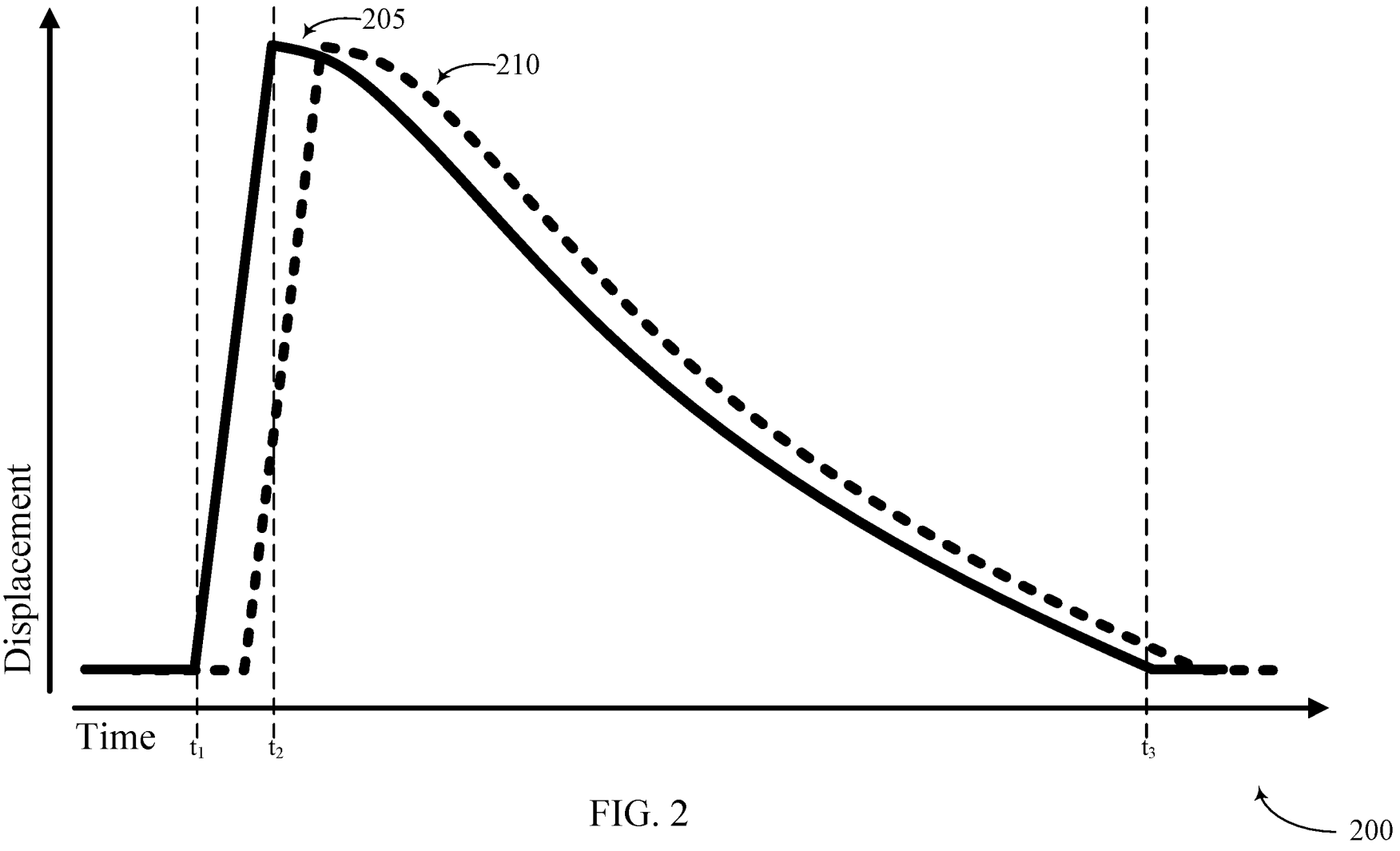
FIG. 2 illustrates an example of a subsonic waveform profile that supports an air circulation system in accordance with aspects of the present disclosure

FIG. 2 illustrates an example of a subsonic waveform profile 200 that supports an air circulation system in accordance with aspects of the present disclosure. In some examples, the subsonic waveform profile 200 may implement aspects of the system 100. With reference to FIG. 1, the transducer device 140 may generate one or more air pressure pulses according to the subsonic waveform profile 200, which illustrates a single cycle of a subsonic waveform 205. The subsonic waveform 205 may have an attack portion that may have a duration from $t_1$ to $t_2$ based at least in part on the subsonic waveform profile 200. Additionally, the subsonic waveform 205 may have a decay portion that may have a duration from $t_2$ to $t_3$ based at least in part on the subsonic waveform profile 200. The durations may be measured in milliseconds (ms), seconds (s), etc. In some examples, the subsonic waveform 205 may be associated with a first phase. Alternatively, in some cases, the subsonic waveform 205 may have a phase adjustment resulting in subsonic waveform 210 having a second phase different from the first phase.

The subsonic waveform profile 200 may relate a displacement of a diaphragm of a transducer device as a function of time. For example, according to the subsonic waveform 205 applied to a diaphragm of a transducer device (e.g., for a single cycle), the diaphragm may be compressed quickly from a resting position to a final position (e.g., partially compressed, fully compressed). As the diaphragm of the transducer device is being compressed, an air pressure pulse is generated within a chamber of the diaphragm of the transducer device and propagated outwardly from the transducer device. As the cycles of the subsonic waveform 205 are enlarged, an increased number of air pressure pulses are generated by the diaphragm as a result of the continuous movement of the diaphragm.

The subsonic waveform profile 200 with which a transducer is driven may be asymmetrically-shaped with an attack and decay portion that may be effective for generating air pressure pulses that propagate away from the transducer, and a fundamental frequency of the subsonic waveform 205 may be sub-sonic such that the air pressure pulses generated are inaudible, for example, to humans and domestic pets.

Figure 3:
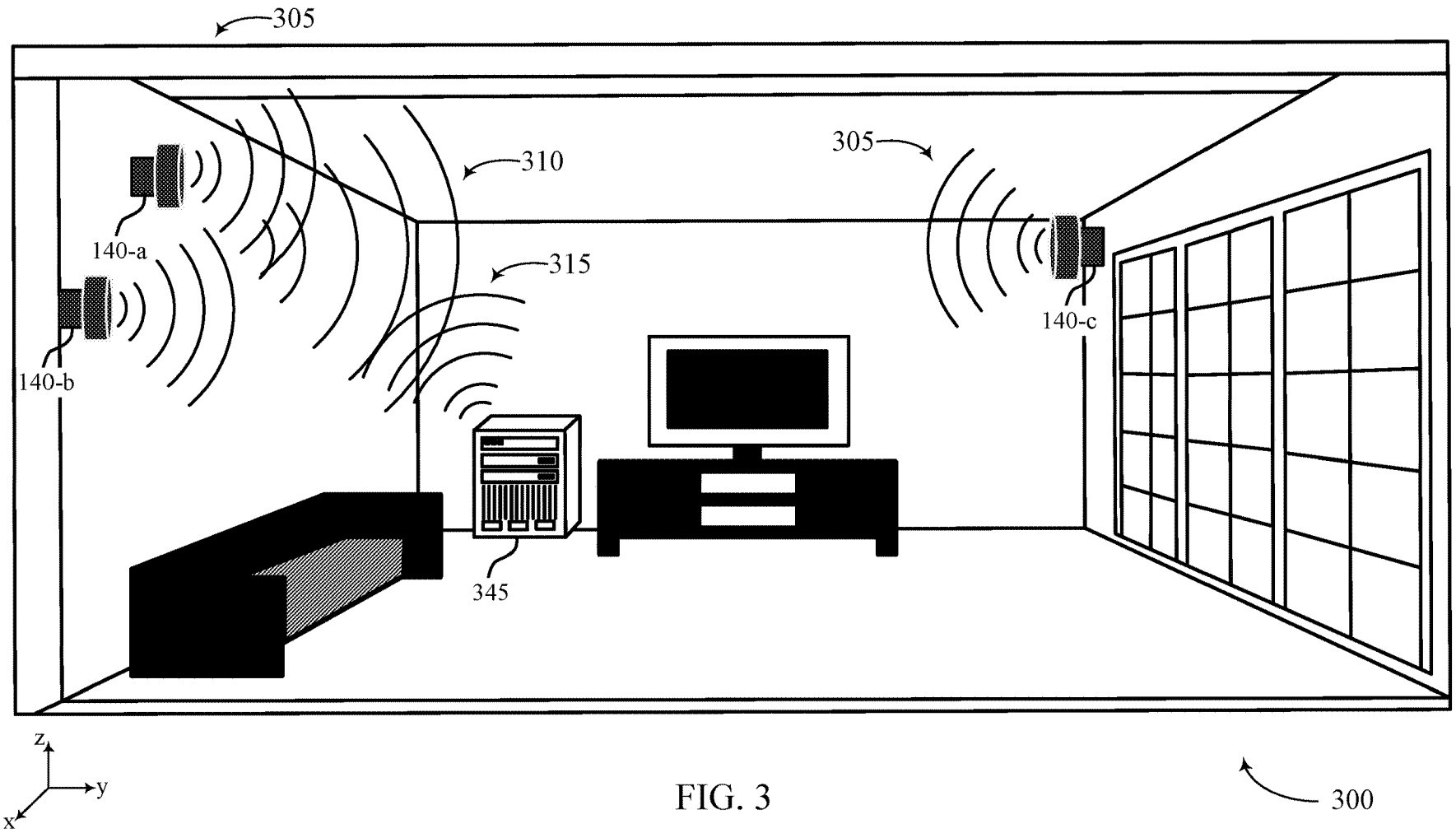
FIG. 3 illustrates an example of an environment for ventilating that supports an air circulation system in accordance with aspects of the present disclosure.

FIG. 3 illustrates an example of an environment 300 that supports an air circulation system in accordance with aspects of the present disclosure. In some examples, the environment 300 may implement aspects of the system 100. For example, the environment 300 may be configured with a number of transducer devices such as, a first transducer device 140-*a*, a second transducer device 140-*b*, and a third transducer device 140-*c*, which may be examples of the corresponding devices described with reference to FIG. 1. The environment 300 may be, in some examples, part of a structure, such as a residential or commercial building. For example, the environment 300 may be a home and in particular, may be a room (e.g., bedroom, living room) including one or more access points (e.g., windows and/or doors) and objects (e.g., furniture, electronic devices) spread throughout the room. The first transducer device 140-*a*, the second transducer device 140-*b*, and the third transducer device 140-*c* may individually or collectively provide air ventilation, heating, and cooling to the environment 300, as described herein.

In some examples, at least the first transducer device 140-*a*, the second transducer device 140-*b*, or the third transducer device 140-*c* may function as a central transducer device (e.g., controller) to coordinate providing air ventilation, heating, and cooling to the environment 300 in coordination with other transducer devices within the environment 300. For example, the first transducer device 140-*a* may be referred to herein as the central transducer device, which may be a Bluetooth controller transducer allowing the air circulation systems (e.g., including transducer devices 140) in environment 300 to be centrally controlled, the transducer devices 140 may be fanless (e.g., absent of a rotating electro-mechanical fan-blade). Although, the second transducer device 140-*b* or the third transducer device 140-*c* may alternatively function as the central transducer device. As the central transducer device, the first transducer device 140-*a* may coordinate operations for a subset or all of the transducer devices 140 within the environment 300. For example, as part of a setup procedure or during normal operation, the first transducer device 140-*a*, the second transducer device 140-*b*, or the third transducer device 140-*c* may establish a connection with each other. The connection may be a wired connection such as, an Ethernet connection, or an optical fiber connection (e.g., shorter-range multi-mode fiber and long-range single-mode fiber), etc. Alternatively, or additionally, the connection may be a wireless connection such as, a Bluetooth connection, Bluetooth low-energy connection, a near-field communication (NFC) connection, or a Wi-Fi connection. Because the first transducer device 140-*a* functions as the controller in the environment 300, it may use the established connection to communicate (e.g., transmit and/or receive) data, instructions, commands, information, signals, bits, symbols, etc. to and from the second transducer device 140-*b* and the third transducer device 140-*c*.

The first transducer device 140-*a*, the second transducer device 140-*b*, and/or the third transducer device 140-*c* may each synchronize their internal clock (e.g. CPU clocks) based on a timing synchronization function. By synchronizing their internal clocks, all of the transducer devices 140 within the environment 300 may communicate with each other in an effective and efficient manner. For example, signaling carrying data, instructions, commands, information, etc. may arrive at the corresponding transducer devices 140 appropriately. Additionally, by synchronizing their internal clocks, the transducer devices 140 may generate air pressure pulses (e.g., coordinate relative phase of the air pressure pulses) such that these pulses combine with a plurality of air pressure pulses from the other transducer devices 140 within the environment 300, as described herein.

In some cases, the central transducer device may configure a subsonic waveform profile to generate air pressure pulses 305 (e.g., sonic pressure waves) that propagate away from each transducer device 140 within the environment 300. The subsonic waveform profile may have one or more parameter values that may include a frequency (e.g., a fundamental frequency in a subsonic frequency range such as 25 Hz), a phase, or an amplitude, or a combination for a waveform. In another example, the parameter values may also include timing information. For example, an indication of when a transducer device 140 within the environment 300 will generate air pressure pulses. A transducer device 140 within the environment 300 may use the timing information such that it may generate air pressure pulses at a timing that will allow its generated pulses to constructively combine with air pressure pulses generated by the other transducer devices in the environment 300. In some cases, reflected air pressure pulses generated by the transducer devices 140 and reflected off of objects, walls, etc. in the environment 300 may constructively combine with other air pressure pulses generated by other transducer devices the environment 300.

In some cases, the air pressure pulses 305 may be based at least in part on a repeating asymmetric waveform having an attack and decay profile that results in the air pressure pulses 305 radiating outward from the transducer devices 140. In some cases, the parameter values may be administrator-defined or system-defined. For example, an administrator may define values for the parameters, or the central transducer device (e.g., the first transducer device 140-*a*) may individually or collectively with the second transducer device 140-*b* and the third transducer device 140-*c* determine values for the parameters based on feedback from the second transducer device 140-*b* and the third transducer device 140-*c*. Therein, the values for the parameters are system-defined.

In some cases, the first transducer device 140-*a* may determine a first subsonic waveform profile having one or more parameter values (e.g., a frequency, a phase, or an amplitude, or a combination thereof) for a waveform (e.g., subsonic waveform). The first transducer device 140-*a* may generate a message including a first subsonic waveform profile and broadcast the message to the second transducer device 140-*b* and the third transducer device 140-*c* within the environment 300. Either or both of the second transducer device 140-*b* and the third transducer device 140-*c* may receive and decode the message to evaluate the parameters of the first subsonic waveform profile. For example, the second transducer device 140-*b* may identify a phase associated with the first subsonic waveform profile based at least in part on the parameters received in the message from the first transducer device 140-*a*. The second transducer device 140-*b* may generate a second subsonic waveform profile using the parameters of the first subsonic waveform profile. For example, the second transducer device 140-*b* may set a phase associated with the second subsonic waveform profile based at least in part on the identified phase associated with the first subsonic waveform profile.

Subsequently during operation, the first transducer device 140-*a* and the second transducer device 140-*b* may generate air pressure pulses 305 based at least in part on their corresponding subsonic waveform profile. In an example, the generated air pressure pulses 305 from the first transducer device 140-*a* and the second transducer device 140-*b* may combine (e.g., constructive interference) and result in air pressure pulses 310, which may have a higher amplitude (e.g., resulting in increased air ventilation, heating, and cooling to the environment 300) compared to the individual generated air pressure pulses 304. The result of the constructive combination of the air pressure pulses may be based at least in part on air pressure pulses 305 associated with the first transducer device 140-*a* arriving at a certain phase and/or time, at the second transducer device 140-*b*, when the second transducer device 140-*b* generates its air pressure pulses 305.

In an example, the third transducer device 140-*c* may also receive the message from the first transducer device 140-*a*. The third transducer device 140-*b* may generate a third subsonic waveform profile using the parameters of the first subsonic waveform profile. For example, the third transducer device 140-*b* may set a phase associated with the third subsonic waveform profile based at least in part on the identified phase associated with the first subsonic waveform profile. Similarly, the generated air pressure pulses 305 associated with the first transducer device 140-*a* and/or the second transducer device 140-*b* may arrive at the third transducer device 140-*b* at a certain phase and/or time. In an example, the generated air pressure pulses 305 associated with the first transducer device 140-*a* and/or the second transducer device 140-*b* may arrive at the third transducer device 140-*b* at a certain phase but different time than indicated in the value of a parameter (e.g., timing field in the message). Thereby, the air pressure pulses 305 generated at the third transducer device 140-*c* may not combine with the air pressure pulses 305 associated with the first transducer device 140-*a* and/or the second transducer device 140-*b* because these pulses may be delayed or ahead of the air pressure pulses 305 generated at the third transducer device 140-*c*. In this case, the third transducer device 140-*c* may transmit feedback to the central transducer device (i.e., in this case the first transducer device 140-*a*) to adjust timing of the second subsonic waveform profile used to generate the air pressure pulses 305. Alternatively, or additionally the third transducer device 140-*c* may have disregarded setting the phase associated with the third subsonic waveform profile based at least in part on the identified phase associated with the first subsonic waveform profile, and instead may have set the phase according to default phase value (e.g. manufactured-defined). In this case, the air pressure pulses 305 generated at the third transducer device 140-*c* may also not combine with the air pressure pulses 305 associated with the first transducer device 140-*a* and/or the second transducer device 140-*b* because these pulses may be out of phase from the air pressure pulses 305 generated at the third transducer device 140-*c*. The third transducer device 140-*c* may correct its phase for its subsonic waveform profile based on feedback transmitted and received from the first transducer device 140-*a*.

The environment 300 may also include an audio source device 345. The first transducer device 140-*a*, the second transducer device 140-*b*, and/or the third transducer device 140-*c* may establish a second connection to the audio source device 345 to support an audio stream originating from the audio source device. For example, the first transducer device 140-*a* may receive, from the audio source device 345, an audio waveform having a plurality of audio pulses 315, for example, based at least in part on the connection (e.g., Bluetooth connection). The first transducer device 140-*a* may superimpose (e.g., add) the plurality of audio pulses 315 on the combined air pressure pulses 310, which may then be propagated. In some examples, first transducer device 140-*a*, the second transducer device 140-*b*, and/or the third transducer device 140-*c* may function as a subwoofer. The superimposition of the combined air pressure pulses 310 being used to provide air circulation, on the plurality of audio pulses 315 (i.e., audio waveform) may be used to assist cooling of the transducer devices 140 itself. As a result, increasing power-handling capabilities for the transducer devices 140. Additionally, the air pressure pulses 305 and/or combined air pressure pulses 310 may not affect the audio waveform because the pulse 305 and/or 310 are in subsonic frequency (i.e., inaudible).

As such, when multiple transducer devices are installed within an environment (e.g., room, enclosure (e.g., smartphone, laptop, appliance)), the devices may be coordinated and arranged in the physical environment, such that the subsonic waveforms in are added (e.g., by coordinating the subsonic waveforms, the transducer devices aid each other in moving air around a space. As a result, improving the efficiency of the air circulating system. The transducer devices also support an efficient and noiseless alternative to conventional air circulation systems, by generating air pressure pulses (e.g., sonic pressure waves) that propagate outwards from the transducer devices, and constructively combine to form larger air pressure pulses. The transducer devices along with the techniques described herein also offer additional advantages including supporting audio data streams, as provided herein. For example, an audio waveform may be superimposed on a subsonic waveform being used to promote air circulation, enabling the transducer devices to be both part of a surround sound system and providing air circulation.

Figure 4:
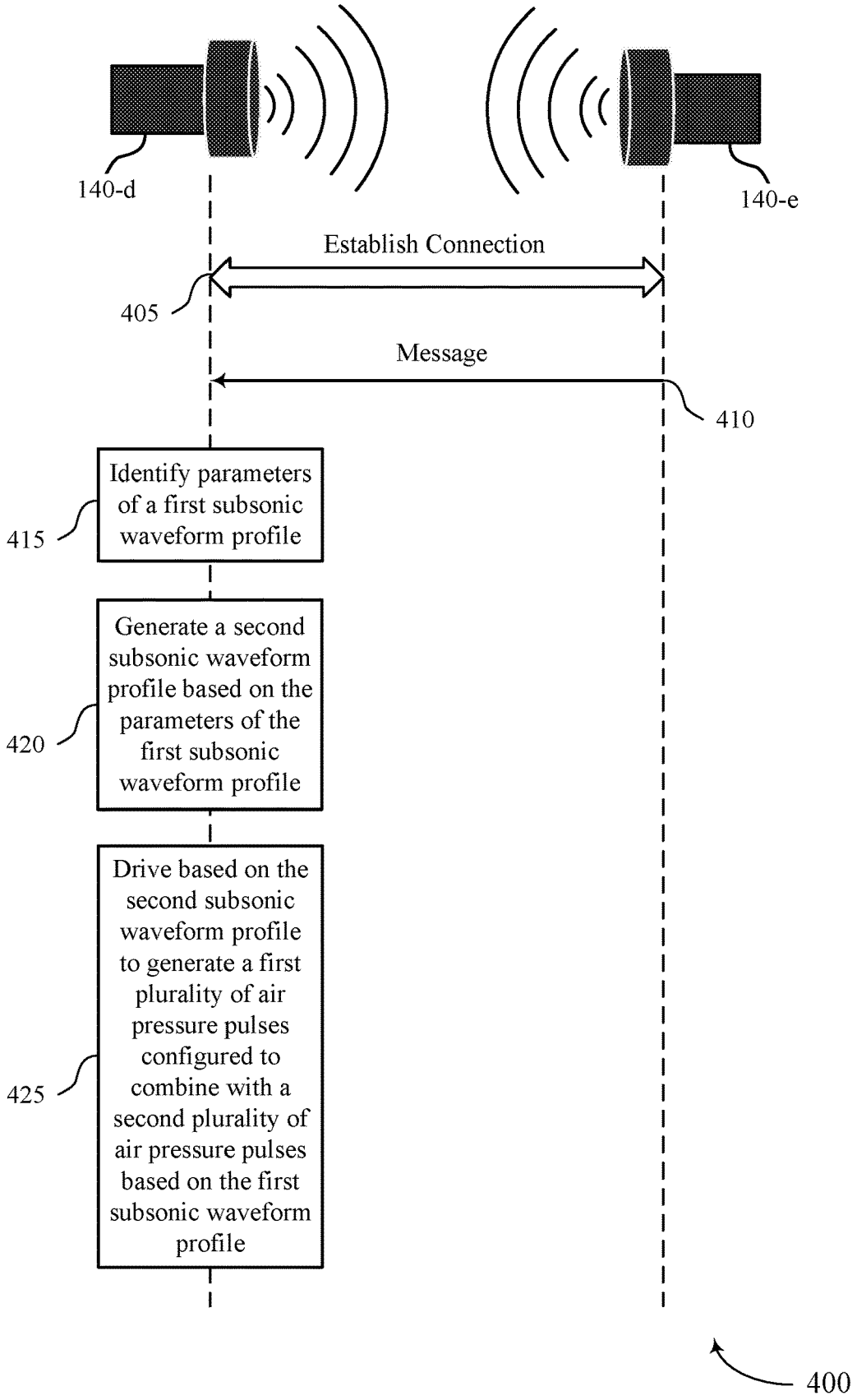
FIG. 4 illustrates an example of a process flow that supports an air circulation system in accordance with aspects of the present disclosure.

FIG. 4 illustrates an example of a process flow 400 that supports an air circulation system in accordance with aspects of the present disclosure. In some examples, the process flow 400 may implement aspects of an air circulation system that may be fanless as described herein. The transducer device 140-*d* and the transducer device 140-*e* may be examples of the corresponding devices described with reference to FIG. 1. In some examples, the transducer device 140-*d* and the transducer device 140-*e* may be standalone devices or part of another device (e.g., configured with, embedded within, or installed on device 115). The process flow may include operations that eliminates challenges related to conventional air circulation systems.

In the following description of the process flow 400, the operations between the transducer device 140-*d* and the transducer device 140-*e* may be transmitted in a different order than the exemplary order shown, or the operations performed by the transducer device 140-*d* and the transducer device 140-*e* may be performed in different orders or at different times. Certain operations may also be left out of the process flow 400, or other operations may be added to the process flow 400.

At 405, the transducer device 140-*d* may establish a connection with the transducer device 140-*e*. In some examples, the connection may be a wired connection such as, an Ethernet connection, or an optical fiber connection (e.g., shorter-range multi-mode fiber and long-range single-mode fiber), etc. Alternatively, or additionally, the connection may be a wireless connection such as, a Bluetooth connection, Bluetooth low-energy connection, a near-field communication (NFC) connection, or a Wi-Fi connection. In some cases, the transducer device 140-*d* may function as a central transducer device, for example, a controller coordinating operations related to itself and other transducer devices, such as transducer device 140-*e*. In this case, the transducer device 140-*d* may use the established connection to communicate (e.g., transmit and/or receive) data, instructions, commands, information, signals, bits, symbols, etc. to and from the transducer device 140-*e*.

In some examples, as part of establishing the connection, the transducer device 140-*d* and the transducer device 140-*e* may each synchronize their internal clock (e.g. processor clocks) based on a timing synchronization function. By synchronizing their internal clocks, both the transducer device 140-*d* and the transducer device 140-*e* may communicate with each other in an effective and efficient manner. For example, signaling carrying data, instructions, commands, information, etc. may arrive at the corresponding transducer device appropriately. Additionally, by synchronizing their internal clocks, the transducer device 140-*d* and the transducer device 140-*e* may generate air pressure pulses such that these pulses combine with a plurality of air pressure pulses from another transducer device.

At 410, the transducer device 140-*e* may transmit a message including information related to parameters of a subsonic waveform profile. In some example, the parameters may include a frequency, a phase, or an amplitude, or a combination thereof associated with a waveform (e.g., a subsonic waveform). At 415, the transducer device 140-*d* may receive the message and identify parameters of a first subsonic waveform profile (e.g., associated with the transducer device 140-*e*). For example, the transducer device 140-*d* may identify a frequency, a phase, or an amplitude, or a combination thereof associated with a waveform (e.g., a subsonic waveform) defined by the first subsonic waveform profile.

At 420, the transducer device 140-*d* may generate a second subsonic waveform profile based on the parameters of the first subsonic waveform profile. The second subsonic waveform profile may define a waveform (e.g., a subsonic waveform) having same or different parameters compared to the waveform (e.g., a subsonic waveform) defined by the first subsonic waveform profile. For example, the second subsonic waveform profile may define a waveform (e.g., a subsonic waveform) having a same amplitude and frequency as the waveform defined by the first subsonic waveform profile, and vary only in phase. The two waveforms may vary in phase such that both waveforms may be constructively combined.

At 425, the transducer device 140-*d* may drive based on the second subsonic waveform to generate a first plurality of air pressure pulses configured to combine with a second plurality of air pressure pulses based on the first subsonic waveform profile. The air pressure pulses may have a characteristic (e.g., frequency, amplitude, phase) defined by the waveform profile.

The transducer device 140-*d* and the transducer device 140-*e* may support an efficient and noiseless alternative to conventional air circulation systems, by generating air pressure pulses (e.g., sonic pressure waves) that propagate outwards from the transducer devices 140-*d* and 140-*e*, and constructively combine to form larger air pressure pulses.

Figure 5:
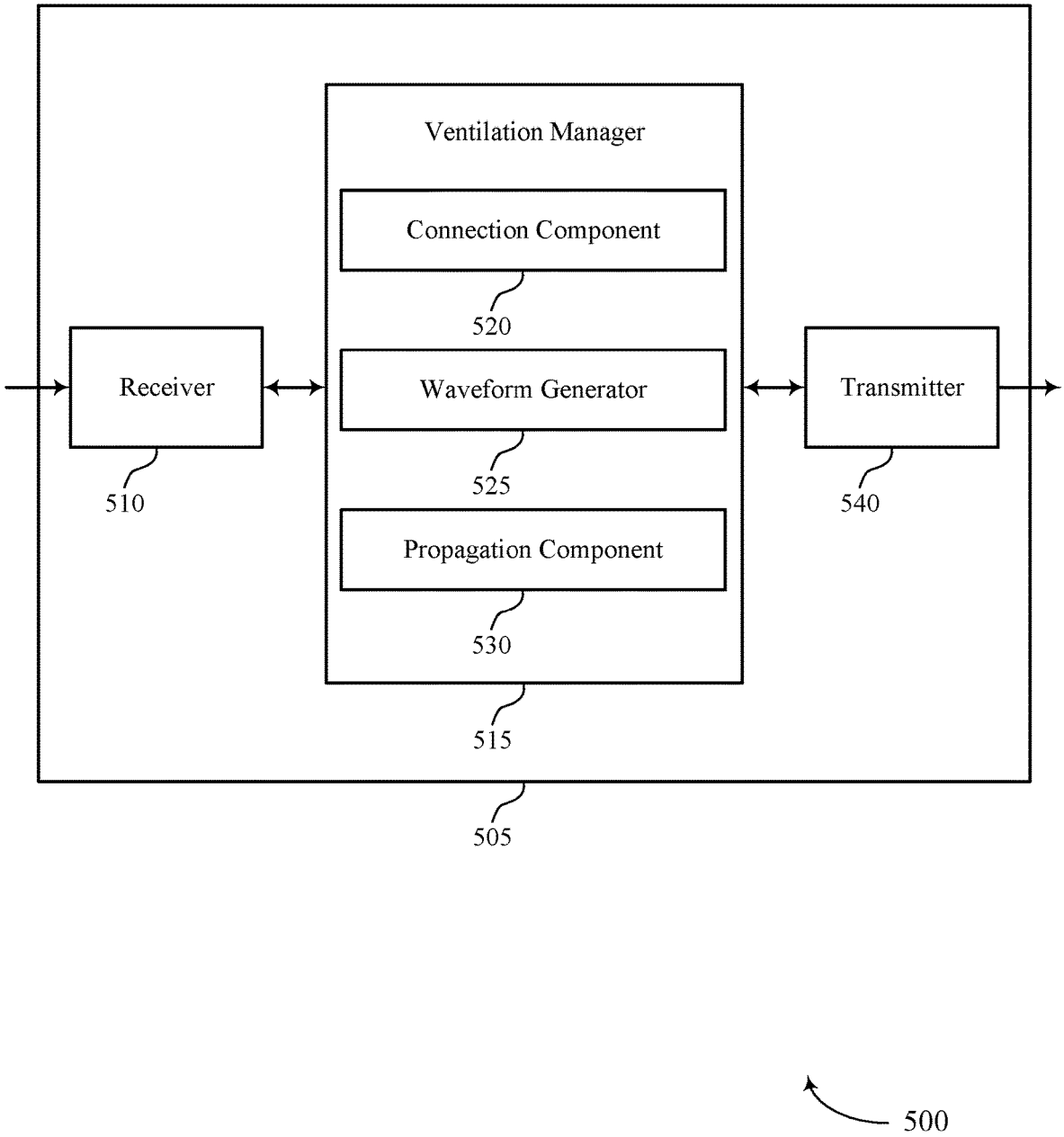
FIG. 5 shows a block diagram of a device that supports an air circulation system in accordance with aspects of the present disclosure.

FIG. 5 shows a block diagram 500 of a transducer device 505 that supports an air circulation system in accordance with aspects of the present disclosure. The transducer device 505 may be an example of aspects of a transducer device or a device 115 as described herein. The transducer device 505 may include a receiver 510, a ventilation manager 515, and a transmitter 540. The transducer device 505 may also include a processor. Each of these components may be in communication with one another (e.g., via one or more buses).

The receiver 510 may receive information such as packets, user data, or control information associated with various information channels (e.g., control channels, data channels, and information related to air circulation system, etc.). Information may be passed on to other components of the transducer device 505. The receiver 510 may be an example of aspects of the transceiver 720 described with reference to FIG. 7. The receiver 510 may utilize a single antenna or a set of antennas.

The receiver 510 may receive a message from the first transducer device including parameters of a first subsonic waveform profile of the first transducer device. In some examples, the receiver 510 may receive feedback from the first transducer device based on a second message including parameters of a second subsonic waveform profile including a set phase. In some examples, the receiver 510 may receive, from an audio source device, an audio waveform having a set of audio pulses based on a second wireless connection.

The ventilation manager 515, or its sub-components, may be implemented in hardware, code (e.g., software or firmware) executed by a processor, or any combination thereof. If implemented in code executed by a processor, the functions of the ventilation manager 515, or its sub-components may be executed by a general-purpose processor, a DSP, an application-specific integrated circuit (ASIC), a FPGA or other programmable logic device, discrete gate or transistor logic, discrete hardware components, or any combination thereof designed to perform the functions described in the present disclosure.

The ventilation manager 515, or its sub-components, may be physically located at various positions, including being distributed such that portions of functions are implemented at different physical locations by one or more physical components. In some examples, the ventilation manager 515, or its sub-components, may be a separate and distinct component in accordance with various aspects of the present disclosure. In some examples, the ventilation manager 515, or its sub-components, may be combined with one or more other hardware components, including but not limited to an input/output (I/O) component, a transceiver, a network server, another computing device, one or more other components described in the present disclosure, or a combination thereof in accordance with various aspects of the present disclosure.

The ventilation manager 515 may be an example of aspects of the ventilation manager 515 as described herein. The ventilation manager 515 may include a connection component 520, a waveform generator 525, and a propagation component 530. The ventilation manager 515 may be an example of aspects of the ventilation manager 710 described herein. The connection component 520 may establish a wireless connection between a first transducer device and a (second) transducer device 505. The waveform generator 525 may generate at the (second) transducer device 505 a second subsonic waveform profile based on the parameters of the first subsonic waveform profile. The propagation component 535 may drive the (second) transducer device 505 based on the second subsonic waveform profile to generate a first set of air pressure pulses configured to combine with a second set of air pressure pulses based on the first subsonic waveform profile.

The transmitter 540 may transmit signals generated by other components of the transducer device 505. In some examples, the transmitter 540 may be collocated with a receiver 510 in a transceiver module. For example, the transmitter 540 may be an example of aspects of the transceiver 720 described with reference to FIG. 7. The transmitter 540 may utilize a single antenna or a set of antennas. The transmitter 540 may transmit, to the first transducer device, a second message from the (second) transducer device 505 including parameters of the second subsonic waveform profile including the set phase.

Figure 6:
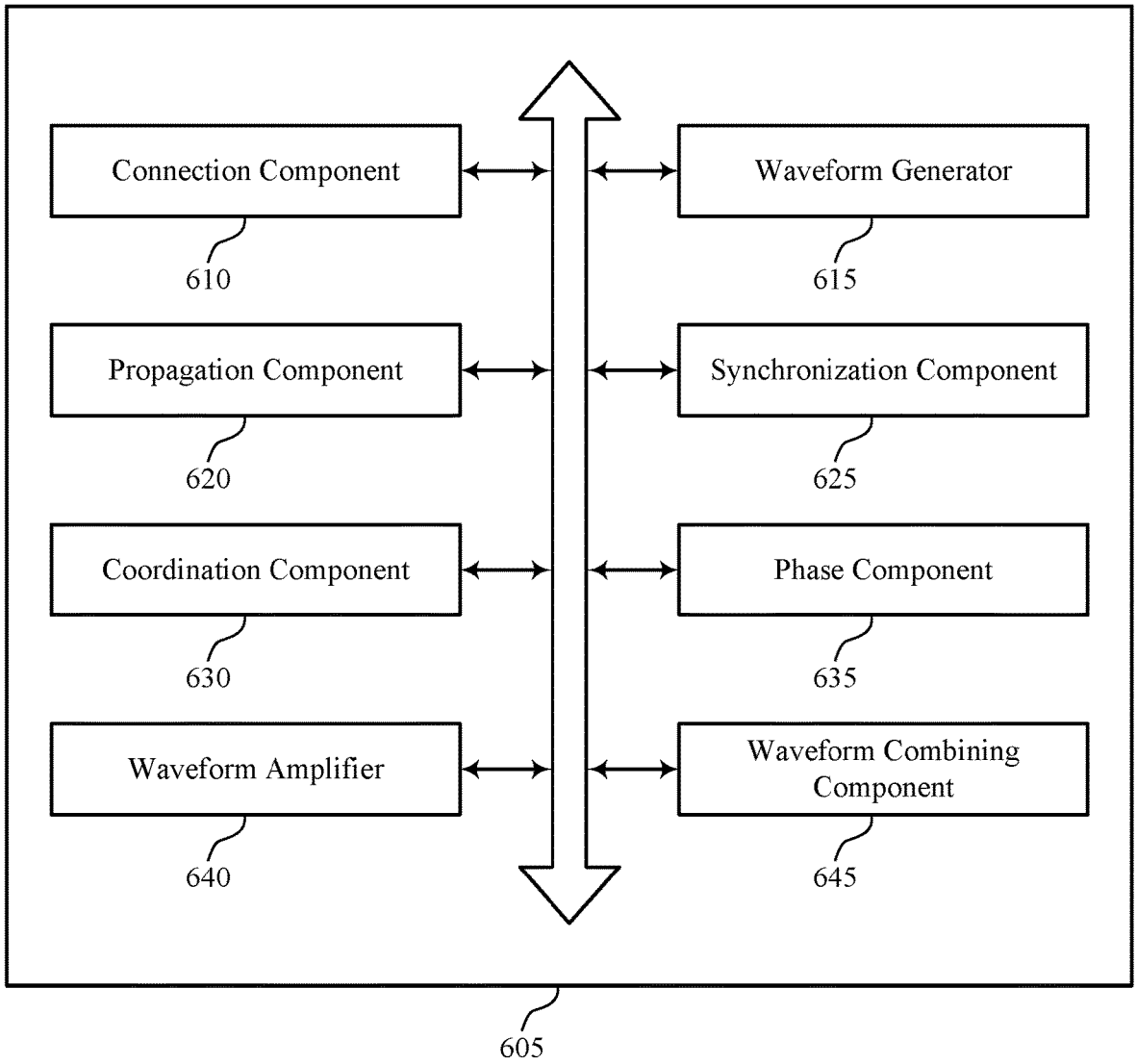
FIG. 6 shows a block diagram of a ventilation manager that supports an air circulation system in accordance with aspects of the present disclosure.

FIG. 6 shows a block diagram 600 of a ventilation manager 605 that supports an air circulation system in accordance with aspects of the present disclosure. The ventilation manager 605 may be an example of aspects of a ventilation manager 515 or a ventilation manager 710 described herein. The ventilation manager 605 may include a connection component 610, a waveform generator 615, a propagation component 620, a synchronization component 625, a coordination component 630, a phase component 635, a waveform amplifier 640, and a waveform combining component 645. Each of these modules may communicate, directly or indirectly, with one another (e.g., via one or more buses).

The connection component 610 may establish a wireless connection between a first transducer device and a second transducer device. In some examples, the connection component 610 may establish a second wireless connection between the second transducer device and an audio source device. The waveform generator 615 may generate at the second transducer device a second subsonic waveform profile based on parameters of a first subsonic waveform profile.

The propagation component 620 may drive the second transducer device based on a second subsonic waveform profile to generate a first set of air pressure pulses configured to combine with a second set of air pressure pulses based on the first subsonic waveform profile. In some examples, the propagation component 620 may propagate a set of audio pulses on the combined first set of air pressure pulses and the second set of air pressure pulse based on a superimposing of the audio pulses on the combined set of pulses, where driving the second transducer device is based on propagating the set of audio pulses on the combined first set of air pressure pulses and the second set of air pressure pulse.

The synchronization component 625 may synchronize a clock of the second transducer device with a clock of the first transducer device based on a timing synchronization function. The coordination component 630 may coordinate the second transducer device to generate the first set of air pressure pulses based on the synchronizing, where the first set of air pressure pulses combine with the second set of air pressure pulses based on the coordination.

The phase component 635 may identify a phase associated with the first subsonic waveform profile based on the parameters received in a message from the first transducer device. In some examples, the phase component 635 may set a phase associated with the second subsonic waveform profile based on the identified phase associated with the first subsonic waveform profile, where generating at the second transducer device the second subsonic waveform profile is based on the set phase associated with the second subsonic waveform profile. In some examples, the phase component 635 may adjust the phase associated with the second subsonic waveform profile based on the feedback.

The waveform amplifier 640 may constructively combine the first set of air pressure pulses with the second set of air pressure pulses based on the phase associated with the first subsonic waveform profile and the phase associated with the second subsonic waveform profile. The waveform combining component 655 may superimpose the set of audio pulses on the combined first set of air pressure pulses and the second set of air pressure pulses.

Figure 7:
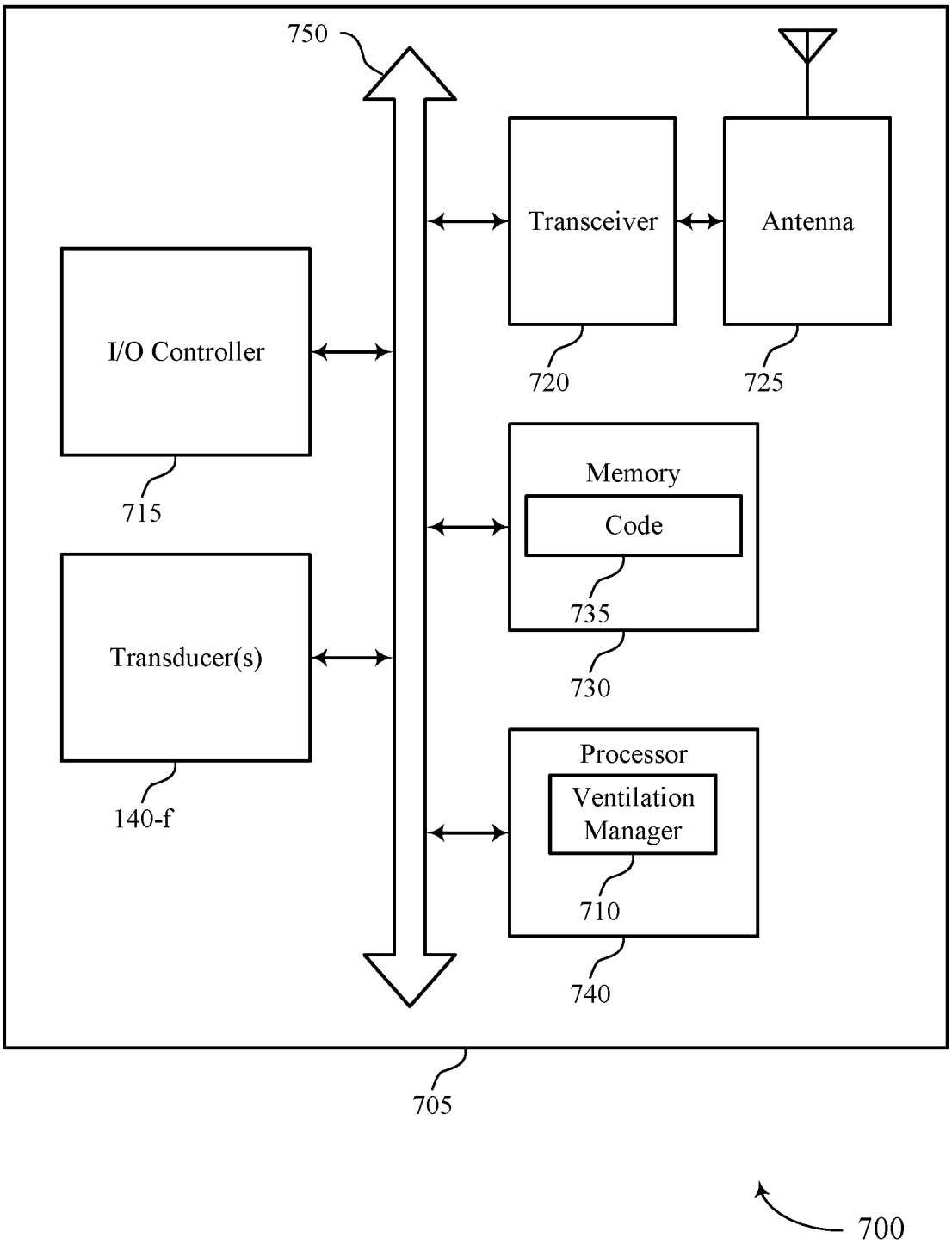
FIG. 7 shows a diagram of a system including a device that supports an air circulation system in accordance with aspects of the present disclosure.

FIG. 7 shows a diagram of a system 700 including a transducer device 705 that supports an air circulation system in accordance with aspects of the present disclosure. The transducer device 705 may be an example of or include the components of transducer device 505 or a transducer device as described herein. The transducer device 705 may include components for bi-directional voice and data communications including components for transmitting and receiving communications, including a ventilation manager 710, an I/O controller 715, a transceiver 720, an antenna 725, memory 730, a processor 740, and a transducer 140-*f* These components may be in electronic communication via one or more buses (e.g., bus 750).

The ventilation manager 710 may establish a wireless connection between a first transducer device and the (second) transducer device 705, receive a message from the first transducer device including parameters of a first subsonic waveform profile of the first transducer device, generate at the (second) transducer device 705 a second subsonic waveform profile based on the parameters of the first subsonic waveform profile, and drive the (second) transducer device 705 based on the second subsonic waveform profile to generate a first set of air pressure pulses configured to combine with a second set of air pressure pulses based on the first subsonic waveform profile.

The transducer 140-*f* may be an example of aspects of a transducer device or a device 115 as described herein. In some examples, the transducer 140-*f* may convert variations in a physical quantity, such as pressure into an electrical signal or vice versa. The transducer 140-*f* may have a diaphragm that is drive to support repeating asymmetric waveforms having an attack and decay profile that results in air pressure pulses radiating outward from the transducer devices 140-*f* In some examples, the transducer 140-*f* may affect an environment (e.g., fans, air conditioner, heater, air freshener, humidifier). In another example, the transducer 140-*f* may be configured as a subwoofer. In some examples, the transducer 140-*f* may generate a first set of air pressure pulses configured to combine with a second set of air pressure pulses based on the first subsonic waveform profile. In some examples, the transducer device 705 may have an amplifier circuit to amplify the generated air pressure pulses at the transducer device 705. In some implementations, the transducer 140-*f* may provide ventilation for the transducer device 705 itself, for example, to fan internal circuitry of the transducer device 705 such as the processor 740, etc.

The I/O controller 715 may manage input and output signals for the transducer device 705. The I/O controller 715 may also manage peripherals not integrated into the transducer device 705. In some cases, the I/O controller 715 may represent a physical connection or port to an external peripheral. In some cases, the I/O controller 715 may utilize an operating system such as iOS, android, MS-DOS, MS-Windows, OS/X, Unix, Linux, or another known operating system. In other cases, the I/O controller 715 may represent or interact with a modem, a keyboard, a mouse, a touch-screen, or a similar device. In some cases, the I/O controller 715 may be implemented as part of a processor. In some cases, a user may interact with the transducer device 705 via the I/O controller 715 or via hardware components controlled by the I/O controller 715.

The transceiver 720 may communicate bi-directionally, via one or more antennas, wired, or wireless links as described above. For example, the transceiver 720 may represent a wireless transceiver and may communicate bi-directionally with another wireless transceiver. For example, the transducer device 705 may transmit, via the transceiver 720, a message to another transducer device including parameters of a subsonic waveform profile including a set phase, such that the other transducer device may set a phase of its subsonic waveform profile. In some examples, the transducer device 705 may receive, via the transceiver 720, feedback (e.g., an indication to modify the set phase) from the other transducer device and adjust the set phase associated with the subsonic waveform profile based on the feedback. The transceiver 720 may also include a modem to modulate the packets and provide the modulated packets to the antennas for transmission, and to demodulate packets received from the antennas. In some cases, the transducer device 705 may include a single antenna 725. However, in some cases the device may have more than one antenna 725, which may be capable of concurrently transmitting or receiving multiple wireless transmissions.

The memory 730 may include RAM and ROM. The memory 730 may store computer-readable, computer-executable code 735 including instructions that, when executed, cause the processor to perform various functions described herein. In some cases, the memory 730 may contain, among other things, a BIOS which may control basic hardware or software operation such as the interaction with peripheral components or devices.

The code 735 may include instructions to implement aspects of the present disclosure, including instructions to support ventilating. The code 735 may be stored in a non-transitory computer-readable medium such as system memory or other type of memory. In some cases, the code 735 may not be directly executable by the processor 740 but may cause a computer (e.g., when compiled and executed) to perform functions described herein.

The processor 740 may include an intelligent hardware device, (e.g., a general-purpose processor, a DSP, a CPU, a microcontroller, an ASIC, an FPGA, a programmable logic device, a discrete gate or transistor logic component, a discrete hardware component, or any combination thereof). In some examples, the processor 740 may be a microcontroller configured to perform various functions (e.g., functions or tasks supporting air circulation system). In some cases, the processor 740 may be configured to operate a memory array using a memory controller. In other cases, a memory controller may be integrated into the processor 740. The processor 740 may be configured to execute computer-readable instructions stored in a memory (e.g., the memory 730) to cause the transducer device 705 to perform various functions (e.g., functions or tasks supporting air circulation system).

Figure 8:
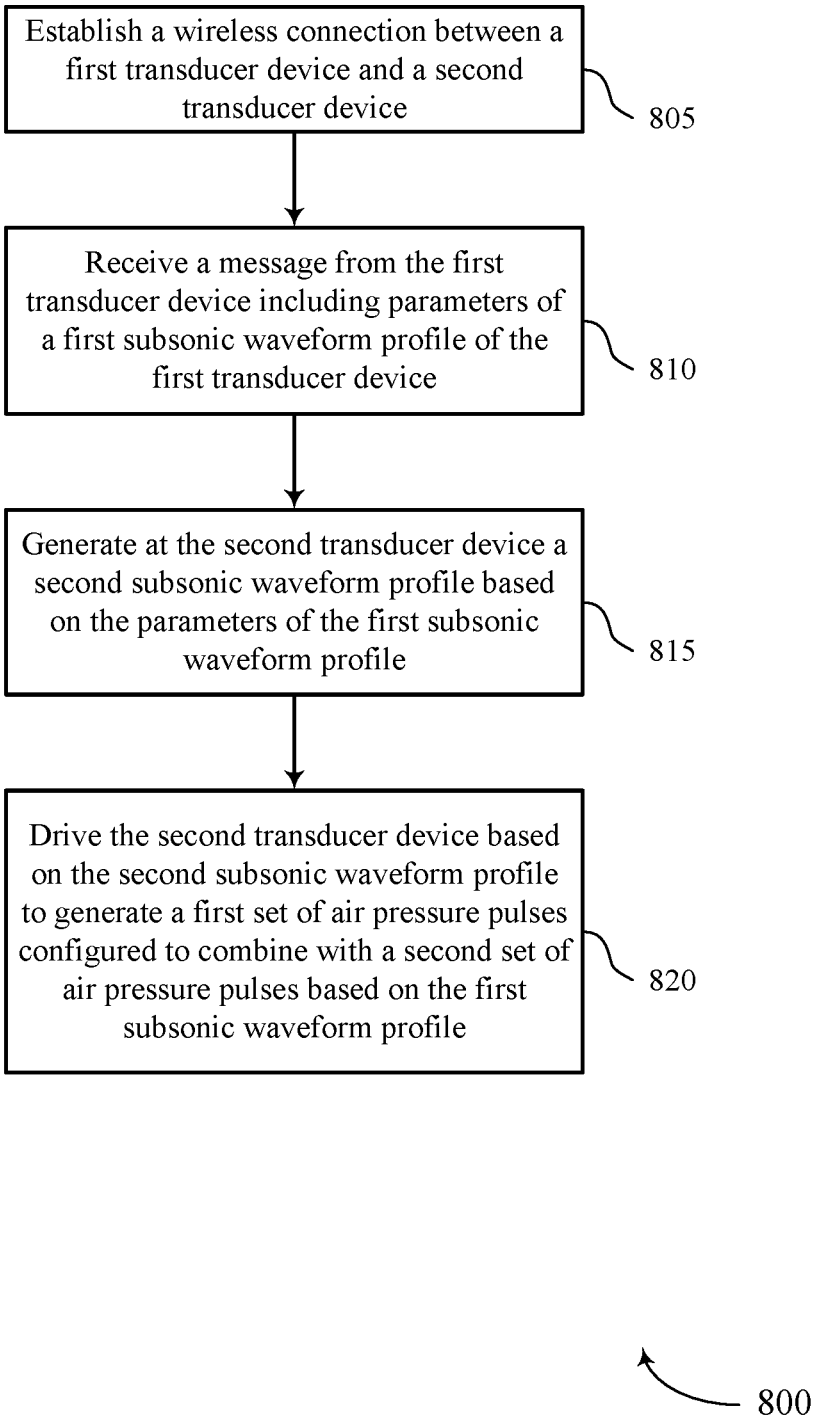
FIGS. 8 through 11 show flowcharts illustrating methods that support an air circulation system in accordance with aspects of the present disclosure.

FIG. 8 shows a flowchart illustrating a method 800 that supports an air circulation system in accordance with aspects of the present disclosure. The operations of method 800 may be implemented by a device or its components as described herein. For example, the operations of method 800 may be performed by a ventilation manager as described with reference to FIGS. 5 through 7. In some examples, a transducer device may execute a set of instructions to control the functional elements of the transducer device to perform the functions described below. Additionally or alternatively, a transducer device may perform aspects of the functions described below using special-purpose hardware.

At 805, a second transducer device may establish a wireless connection between a first transducer device and the second transducer device. The operations of 805 may be performed according to the methods described herein. In some examples, aspects of the operations of 805 may be performed by a connection component as described with reference to FIGS. 5 through 7.

At 810, the second transducer device may receive a message from the first transducer device including parameters of a first subsonic waveform profile of the first transducer device. The operations of 810 may be performed according to the methods described herein. In some examples, aspects of the operations of 810 may be performed by a receiver as described with reference to FIGS. 5 through 7.

At 815, the second transducer device may generate at the second transducer device a second subsonic waveform profile based on the parameters of the first subsonic waveform profile. The operations of 815 may be performed according to the methods described herein. In some examples, aspects of the operations of 815 may be performed by a waveform generator as described with reference to FIGS. 5 through 7.

At 820, the second transducer device may drive the second transducer device based on the second subsonic waveform profile to generate a first set of air pressure pulses configured to combine with a second set of air pressure pulses based on the first subsonic waveform profile. The operations of 820 may be performed according to the methods described herein. In some examples, aspects of the operations of 820 may be performed by a propagation component as described with reference to FIGS. 5 through 7.

Figure 9:
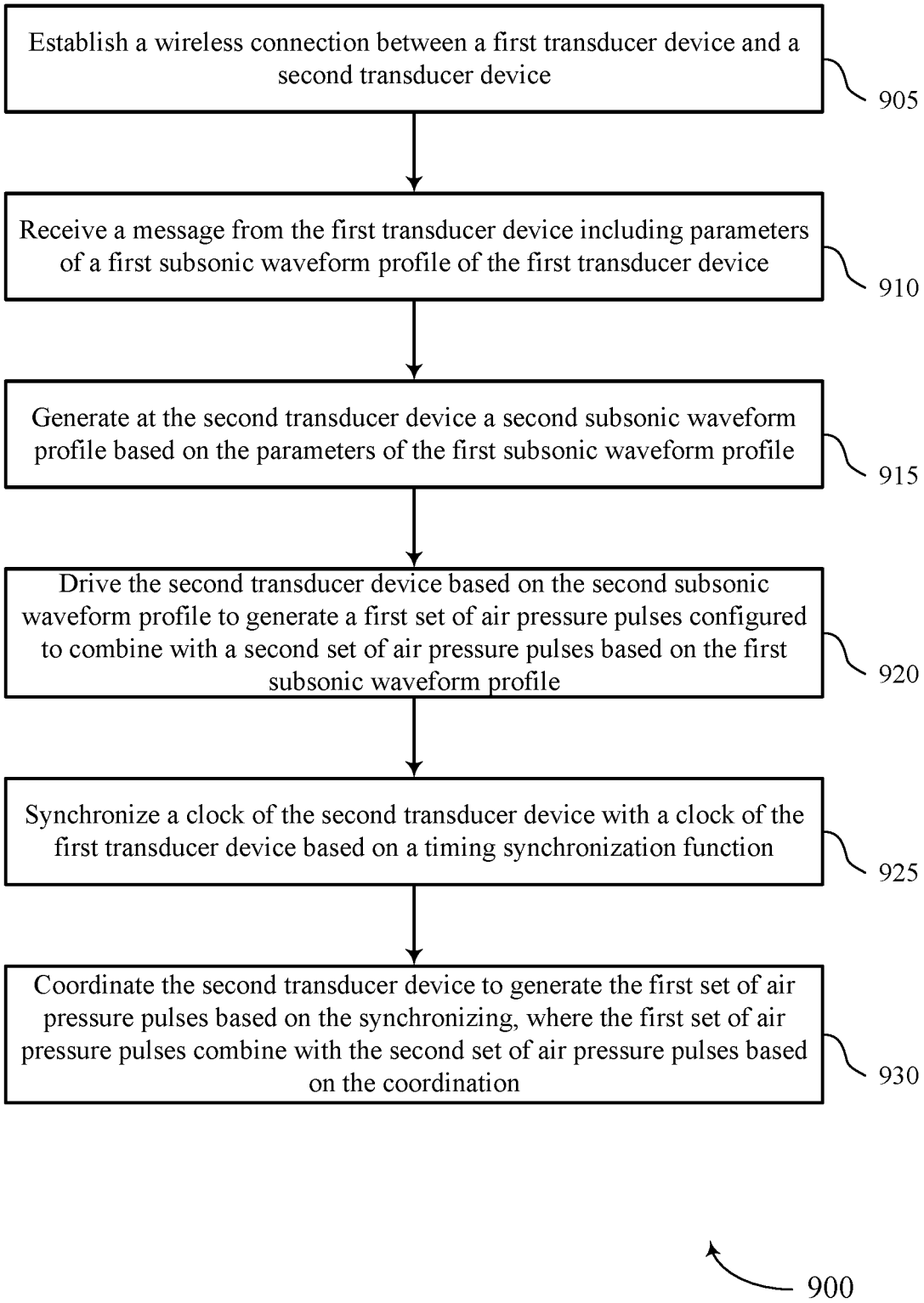

FIG. 9 shows a flowchart illustrating a method 900 that supports an air circulation system in accordance with aspects of the present disclosure. The operations of method 900 may be implemented by a device or its components as described herein. For example, the operations of method 900 may be performed by a ventilation manager as described with reference to FIGS. 5 through 7. In some examples, a transducer device may execute a set of instructions to control the functional elements of the transducer device to perform the functions described below. Additionally or alternatively, a transducer device may perform aspects of the functions described below using special-purpose hardware.

At 905, a second transducer device may establish a wireless connection between a first transducer device and the second transducer device. The operations of 905 may be performed according to the methods described herein. In some examples, aspects of the operations of 905 may be performed by a connection component as described with reference to FIGS. 5 through 7.

At 910, the second transducer device may receive a message from the first transducer device including parameters of a first subsonic waveform profile of the first transducer device. The operations of 910 may be performed according to the methods described herein. In some examples, aspects of the operations of 910 may be performed by a receiver as described with reference to FIGS. 5 through 7.

At 915, the second transducer device may generate at the second transducer device a second subsonic waveform profile based on the parameters of the first subsonic waveform profile. The operations of 915 may be performed according to the methods described herein. In some examples, aspects of the operations of 915 may be performed by a waveform generator as described with reference to FIGS. 5 through 7.

At 920, the second transducer device may drive the second transducer device based on the second subsonic waveform profile to generate a first set of air pressure pulses configured to combine with a second set of air pressure pulses based on the first subsonic waveform profile. The operations of 920 may be performed according to the methods described herein. In some examples, aspects of the operations of 920 may be performed by a propagation component as described with reference to FIGS. 5 through 7.

At 925, the second transducer device may synchronize a clock of the second transducer device with a clock of the first transducer device based on a timing synchronization function. The operations of 925 may be performed according to the methods described herein. In some examples, aspects of the operations of 925 may be performed by a synchronization component as described with reference to FIGS. 5 through 7.

At 930, the second transducer device may coordinate the second transducer device to generate the first set of air pressure pulses based on the synchronizing, where the first set of air pressure pulses combine with the second set of air pressure pulses based on the coordination. The operations of 930 may be performed according to the methods described herein. In some examples, aspects of the operations of 930 may be performed by a coordination component as described with reference to FIGS. 5 through 7.

Figure 10:
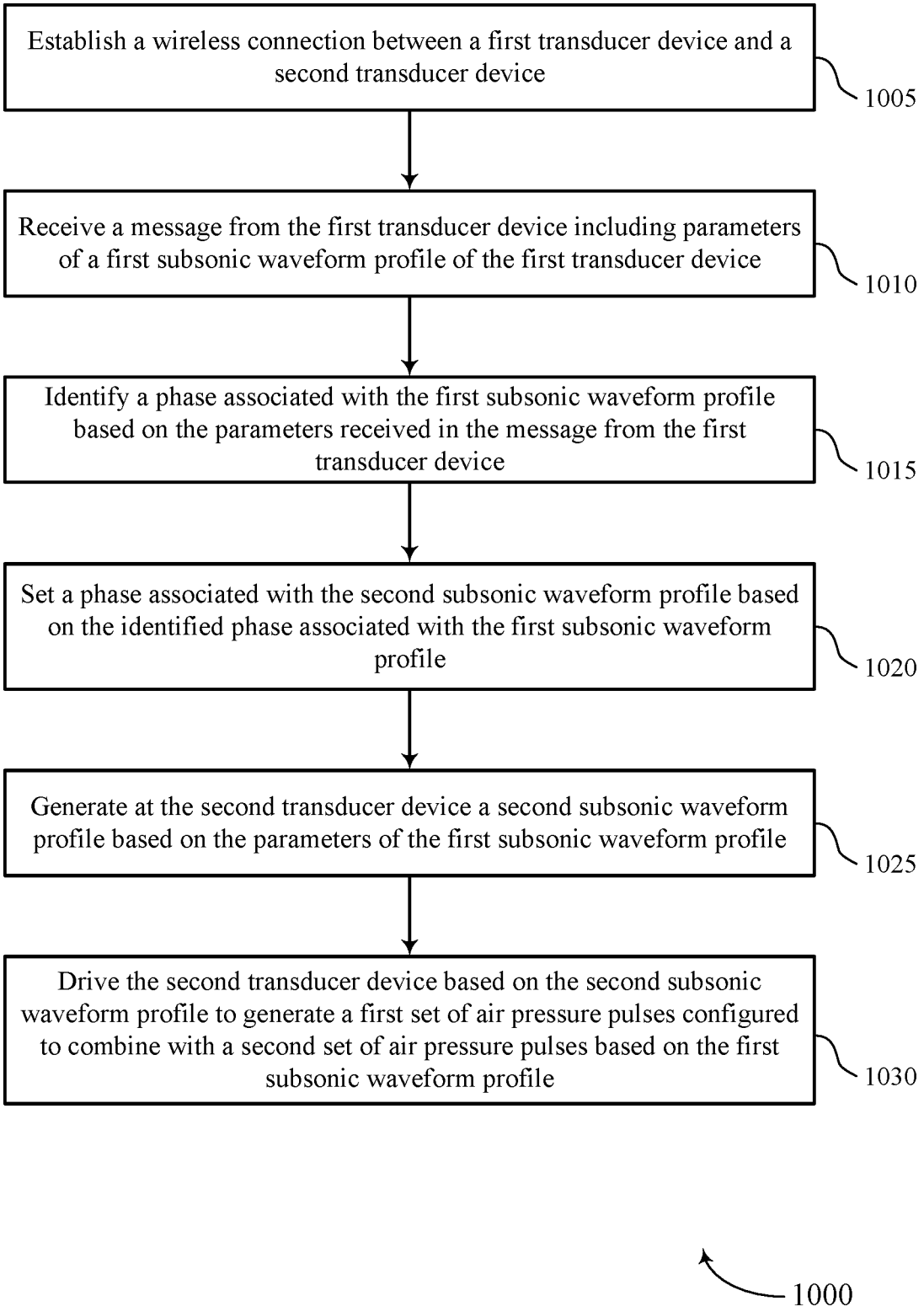

FIG. 10 shows a flowchart illustrating a method 1000 that supports an air circulation system in accordance with aspects of the present disclosure. The operations of method 1000 may be implemented by a device or its components as described herein. For example, the operations of method 1000 may be performed by a ventilation manager as described with reference to FIGS. 5 through 7. In some examples, a transducer device may execute a set of instructions to control the functional elements of the transducer device to perform the functions described below. Additionally or alternatively, a transducer device may perform aspects of the functions described below using special-purpose hardware.

At 1005, a second transducer device may establish a wireless connection between a first transducer device and the second transducer device. The operations of 1005 may be performed according to the methods described herein. In some examples, aspects of the operations of 1005 may be performed by a connection component as described with reference to FIGS. 5 through 7.

At 1010, the second transducer device may receive a message from the first transducer device including parameters of a first subsonic waveform profile of the first transducer device. The operations of 1010 may be performed according to the methods described herein. In some examples, aspects of the operations of 1010 may be performed by a receiver as described with reference to FIGS. 5 through 7.

At 1015, the second transducer device may identify a phase associated with the first subsonic waveform profile based on the parameters received in the message from the first transducer device. The operations of 1015 may be performed according to the methods described herein. In some examples, aspects of the operations of 1015 may be performed by a phase component as described with reference to FIGS. 5 through 7.

At 1020, the second transducer device may set a phase associated with the second subsonic waveform profile based on the identified phase associated with the first subsonic waveform profile. The operations of 1020 may be performed according to the methods described herein. In some examples, aspects of the operations of 1020 may be performed by a phase component as described with reference to FIGS. 5 through 7.

At 1025, the second transducer device may generate at the second transducer device a second subsonic waveform profile based on the parameters of the first subsonic waveform profile. In some examples, generating at the second transducer device the second subsonic waveform profile is based on the set phase associated with the second subsonic waveform profile. The operations of 1025 may be performed according to the methods described herein. In some examples, aspects of the operations of 1025 may be performed by a waveform generator as described with reference to FIGS. 5 through 7.

At 1030, the second transducer device may drive the second transducer device based on the second subsonic waveform profile to generate a first set of air pressure pulses configured to combine with a second set of air pressure pulses based on the first subsonic waveform profile. The operations of 1030 may be performed according to the methods described herein. In some examples, aspects of the operations of 1030 may be performed by a propagation component as described with reference to FIGS. 5 through 7.

Figure 11:
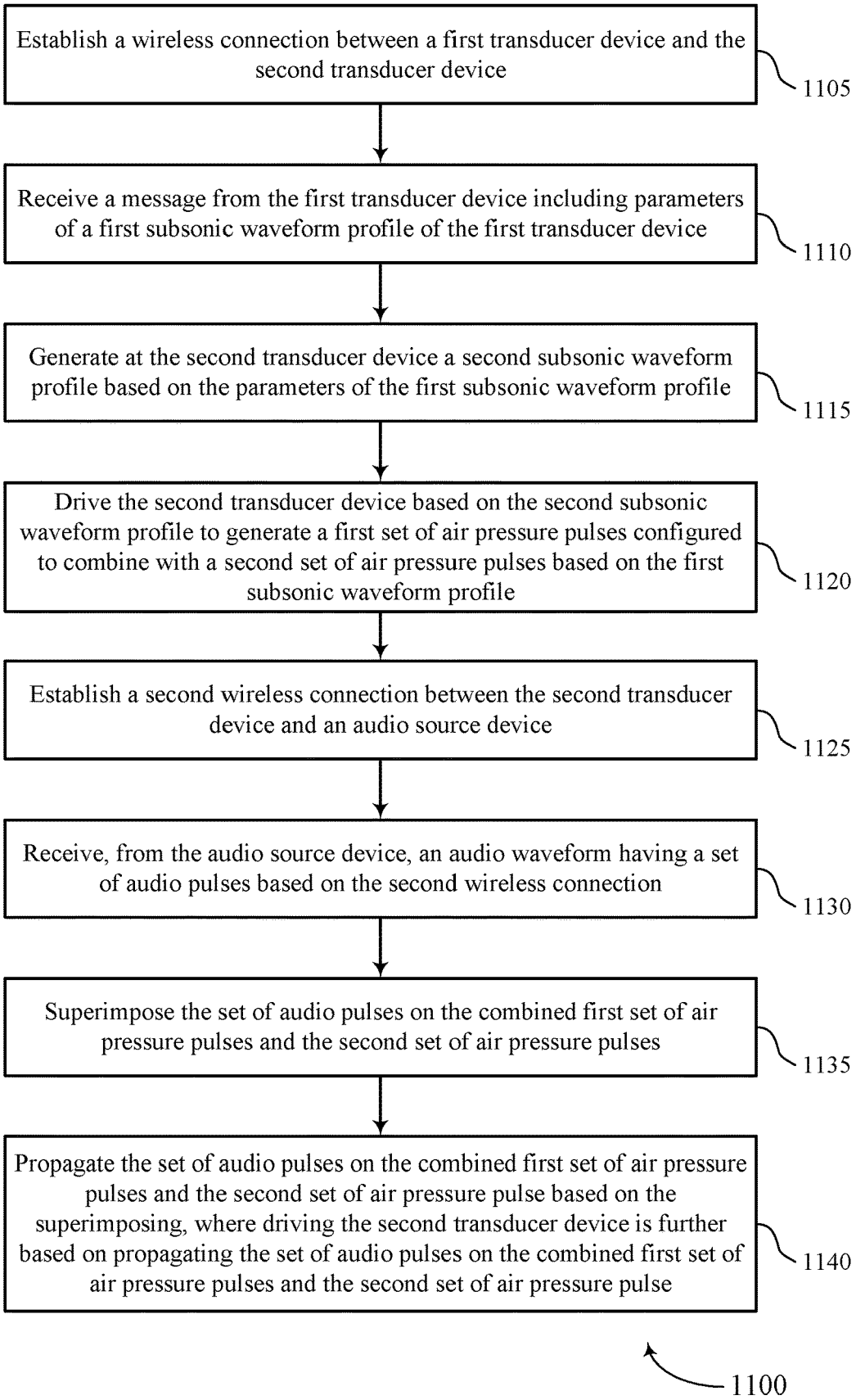

FIG. 11 shows a flowchart illustrating a method 1100 that supports an air circulation system in accordance with aspects of the present disclosure. The operations of method 1100 may be implemented by a device or its components as described herein. For example, the operations of method 1100 may be performed by a ventilation manager as described with reference to FIGS. 5 through 7. In some examples, a transducer device may execute a set of instructions to control the functional elements of the transducer device to perform the functions described below. Additionally or alternatively, a transducer device may perform aspects of the functions described below using special-purpose hardware.

At 1105, a second transducer device may establish a wireless connection between a first transducer device and the second transducer device. The operations of 1105 may be performed according to the methods described herein. In some examples, aspects of the operations of 1105 may be performed by a connection component as described with reference to FIGS. 5 through 7.

At 1110, the second transducer may receive a message from the first transducer device including parameters of a first subsonic waveform profile of the first transducer device. The operations of 1110 may be performed according to the methods described herein. In some examples, aspects of the operations of 1110 may be performed by a receiver as described with reference to FIGS. 5 through 7.

At 1115, the second transducer may generate at the second transducer device a second subsonic waveform profile based on the parameters of the first subsonic waveform profile. The operations of 1115 may be performed according to the methods described herein. In some examples, aspects of the operations of 1115 may be performed by a waveform generator as described with reference to FIGS. 5 through 7.

At 1120, the second transducer may drive the second transducer device based on the second subsonic waveform profile to generate a first set of air pressure pulses configured to combine with a second set of air pressure pulses based on the first subsonic waveform profile. The operations of 1120 may be performed according to the methods described herein. In some examples, aspects of the operations of 1120 may be performed by a propagation component as described with reference to FIGS. 5 through 7.

At 1125, the second transducer may establish a second wireless connection between the second transducer device and an audio source device. The operations of 1125 may be performed according to the methods described herein. In some examples, aspects of the operations of 1125 may be performed by a connection component as described with reference to FIGS. 5 through 7.

At 1130, the second transducer may receive, from the audio source device, an audio waveform having a set of audio pulses based on the second wireless connection. The operations of 1130 may be performed according to the methods described herein. In some examples, aspects of the operations of 1130 may be performed by a receiver as described with reference to FIGS. 5 through 7.

At 1135, the second transducer may superimpose the set of audio pulses on the combined first set of air pressure pulses and the second set of air pressure pulses. The operations of 1135 may be performed according to the methods described herein. In some examples, aspects of the operations of 1135 may be performed by a waveform combining component as described with reference to FIGS. 5 through 7.

At 1140, the second transducer may propagate the set of audio pulses on the combined first set of air pressure pulses and the second set of air pressure pulse based on the superimposing, where driving the second transducer device is further based on propagating the set of audio pulses on the combined first set of air pressure pulses and the second set of air pressure pulse. The operations of 1140 may be performed according to the methods described herein. In some examples, aspects of the operations of 1140 may be performed by a propagation component as described with reference to FIGS. 5 through 7.

It should be noted that the methods described herein describe possible implementations, and that the operations and the steps may be rearranged or otherwise modified and that other implementations are possible. Further, aspects from two or more of the methods may be combined.

The various illustrative blocks and modules described in connection with the disclosure herein may be implemented or performed with a general-purpose processor, a digital signal processor (DSP), an application-specific integrated circuit (ASIC), a field-programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration).

Information and signals described herein may be represented using any of a variety of different technologies and techniques. For example, data, instructions, commands, information, signals, bits, symbols, and chips that may be referenced throughout the description may be represented by voltages, currents, electromagnetic waves, magnetic fields or particles, optical fields or particles, or any combination thereof.

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described herein can be implemented using software executed by a processor, hardware, firmware, hardwiring, or combinations of any of these. Features implementing functions may also be physically located at various positions, including being distributed such that portions of functions are implemented at different physical locations.

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media may include random-access memory (RAM), read-only memory (ROM), electrically erasable programmable read only memory (EEPROM), flash memory, compact disk (CD) ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

As used herein, including in the claims, "or" as used in a list of items (e.g., a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label, or other subsequent reference label.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A method for ventilating, comprising:

establishing a wireless connection between a first transducer device and a second transducer device;

receiving a message from the first transducer device comprising parameters of a first subsonic waveform profile of the first transducer device;

generating at the second transducer device a second subsonic waveform profile based at least in part on the parameters of the first subsonic waveform profile; and driving the second transducer device based at least in part on the second subsonic waveform profile to generate a first plurality of air pressure pulses configured to combine with a second plurality of air pressure pulses based at least in part on the first subsonic waveform profile.

2. The method of claim 1, further comprising:

synchronizing a clock of the second transducer device with a clock of the first transducer device based at least in part on a timing synchronization function; and coordinating the second transducer device to generate the first plurality of air pressure pulses based at least in part on the synchronizing, wherein the first plurality of air pressure pulses combine with the second plurality of air pressure pulses based at least in part on the coordination.

3. The method of claim 1, further comprising:

identifying a phase associated with the first subsonic waveform profile based at least in part on the parameters received in the message from the first transducer device; and setting a phase associated with the second subsonic waveform profile based at least in part on the identified phase associated with the first subsonic waveform profile, wherein generating at the second transducer device the second subsonic waveform profile is based at least in part on the set phase associated with the second subsonic waveform profile.

4. The method of claim 3, further comprising:

transmitting, to the first transducer device, a second message from the second transducer device comprising parameters of the second subsonic waveform profile including the set phase;

receiving feedback from the first transducer device based at least in part on the second message; and adjusting the phase associated with the second subsonic waveform profile based at least in part on the feedback.

5. The method of claim 3, further comprising:

constructively combining the first plurality of air pressure pulses with the second plurality of air pressure pulses based at least in part on the phase associated with the first subsonic waveform profile and the phase associated with the second subsonic waveform profile.

6. The method of claim 1, further comprising:

establishing a second wireless connection between the second transducer device and an audio source device; and receiving, from the audio source device, an audio waveform having a plurality of audio pulses based at least in part on the second wireless connection.

7. The method of claim 6, further comprising:

superimposing the plurality of audio pulses on the combined first plurality of air pressure pulses and the second plurality of air pressure pulses; and propagating the plurality of audio pulses on the combined first plurality of air pressure pulses and the second plurality of air pressure pulse based at least in part on the superimposing, wherein driving the second transducer device is further based at least in part on propagating the plurality of audio pulses on the combined first plurality of air pressure pulses and the second plurality of air pressure pulse.

8. The method of claim 1, wherein the first plurality of air pressure pulses associated with the first subsonic waveform profile and the second plurality of air pressure pulses associated with the second subsonic waveform profile are asymmetrically-shaped.

9. The method of claim 1, wherein the wireless connection comprises one or more of: a Bluetooth connection, Bluetooth low-energy connection, a near-field communication (NFC) connection, or a Wi-Fi connection.

10. The method of claim 1, wherein the first transducer device and the second transducer device comprises a heat-resistance material.

11. The method of claim 1, wherein the first plurality of air pressure pulses associated with the first subsonic waveform profile and the second plurality of air pressure pulses associated with the second subsonic waveform profile have a fundamental frequency in a subsonic frequency range.

12. An apparatus for ventilating, comprising:

a processor, memory in electronic communication with the processor; and instructions stored in the memory and executable by the processor to cause the apparatus to:

establish a wireless connection between another apparatus and the apparatus;

receive a message from the other apparatus comprising parameters of a first subsonic waveform profile of the other apparatus;

generate at the apparatus a second subsonic waveform profile based at least in part on the parameters of the first subsonic waveform profile; and drive the apparatus based at least in part on the second subsonic waveform profile to generate a first plurality of air pressure pulses configured to combine with a second plurality of air pressure pulses based at least in part on the first subsonic waveform profile.

13. The apparatus of claim 12, wherein the instructions are further executable by the processor to cause the apparatus to:

synchronize a clock of the apparatus with a clock of the other apparatus based at least in part on a timing synchronization function; and coordinate the apparatus to generate the first plurality of air pressure pulses based at least in part on the synchronizing, wherein the first plurality of air pressure pulses combine with the second plurality of air pressure pulses based at least in part on the coordination.

14. The apparatus of claim 12, wherein the instructions are further executable by the processor to cause the apparatus to:

identify a phase associated with the first subsonic waveform profile based at least in part on the parameters received in the message from the other apparatus; and set a phase associated with the second subsonic waveform profile based at least in part on the identified phase associated with the first subsonic waveform profile, wherein generating at the apparatus the second subsonic waveform profile is based at least in part on the set phase associated with the second subsonic waveform profile.

15. The apparatus of claim 14, wherein the instructions are further executable by the processor to cause the apparatus to:

transmit, to the other apparatus, a second message from the apparatus comprising parameters of the second subsonic waveform profile including the set phase;

receive feedback from the other apparatus based at least in part on the second message; and adjust the phase associated with the second subsonic waveform profile based at least in part on the feedback.

16. The apparatus of claim 14, wherein the instructions are further executable by the processor to cause the apparatus to:

constructively combine the first plurality of air pressure pulses with the second plurality of air pressure pulses based at least in part on the phase associated with the first subsonic waveform profile and the phase associated with the second subsonic waveform profile.

17. The apparatus of claim 12, wherein the instructions are further executable by the processor to cause the apparatus to:

establish a second wireless connection between the apparatus and an audio source device; and receive, from the audio source device, an audio waveform having a plurality of audio pulses based at least in part on the second wireless connection.

18. The apparatus of claim 17, wherein the instructions are further executable by the processor to cause the apparatus to:

superimpose the plurality of audio pulses on the combined first plurality of air pressure pulses and the second plurality of air pressure pulses; and propagate the plurality of audio pulses on the combined first plurality of air pressure pulses and the second plurality of air pressure pulse based at least in part on the superimposing, wherein driving the apparatus is further based at least in part on propagating the plurality of audio pulses on the combined first plurality of air pressure pulses and the second plurality of air pressure pulse.

19. The apparatus of claim 12, wherein the first plurality of air pressure pulses associated with the first subsonic waveform profile and the second plurality of air pressure pulses associated with the second subsonic waveform profile are asymmetrically-shaped.

20. An apparatus for ventilating, comprising:

means for establishing a wireless connection between another apparatus and the apparatus;

means for receiving a message from the other apparatus comprising parameters of a first subsonic waveform profile of the other apparatus;

means for generating at the apparatus a second subsonic waveform profile based at least in part on the parameters of the first subsonic waveform profile; and means for driving the apparatus based at least in part on the second subsonic waveform profile to generate a first plurality of air pressure pulses configured to combine with a second plurality of air pressure pulses based at least in part on the first subsonic waveform profile.

* * * * *